US005370751A

United States Patent [19]

von Hagen et al.

[11] Patent Number: 5,370,751

[45] Date of Patent: Dec. 6, 1994

[54] HOT ROLLED AND AIR HARDENED STEEL FOR MANUFACTURING STRUCTURAL TUBES AND METHOD THEREOF

[75] Inventors: Ingo von Hagen, Krefeld; Ulrich Menne, Bochum; Ulrich Hoffmann, Duisburg; Bernhard Vogelsang, Langenfeld, all of Germany

[73] Assignee: Mannesmann Aktiengesellschaft, Dusseldorf, Germany

[21] Appl. No.: 74,800

[22] Filed: Jun. 10, 1993

[30] Foreign Application Priority Data

Jun. 10, 1992 [DE] Germany ..... 4219336

[51] Int. Cl.[5] ..... C21D 9/08; C22C 38/28; C22C 38/32

[52] U.S. Cl. ..... 148/330; 148/333; 148/548; 138/177; 49/502; 296/188; 296/146.6

[58] Field of Search ..... 148/330, 333, 548; 420/106; 138/177; 49/502; 296/188, 146 C

[56] References Cited

FOREIGN PATENT DOCUMENTS

| | | | |
|---|---|---|---|
| 3728476C1 | 8/1987 | Germany . | |
| 3935965C1 | 10/1989 | Germany . | |
| 55-1935 | 7/1980 | Japan | 148/330 |
| 57-104656 | 6/1982 | Japan | 420/106 |

*Primary Examiner*—Deborah Yee
*Attorney, Agent, or Firm*—Cohen, Pontani, Lieberman, Pavane

[57] ABSTRACT

An air hardening steel which is killed during casting used as material for manufacturing structural tubes for structural elements which are subjected to high mechanical loads, particularly for door reinforcements in the manufacture of automobiles. The steel is composed of in percent by weight:

0.15–0.30% C
0.50–0.80% Si
2.05–3.35% Mn
max. 0.03% P
max. 0.03% S
0.50–1.00% Cr
max. 0.60% Mo
max. 0.05% Al
0.01–0.05% Ti
0.0015–0.0035% B
0.002–0.015% N remainder iron and impurities, wherein:

$Ti(\%):N(\%) \geqq 3.4\%$ $Mn(\%)+Cr(\%)+Mo(\%)+Si(\%) \geqq 3.3\%$.

4 Claims, No Drawings

HOT ROLLED AND AIR HARDENED STEEL FOR MANUFACTURING STRUCTURAL TUBES AND METHOD THEREOF

BACKGROUND OF THE INVENTION

1. Field of the Invention

The present invention relates to the use of a steel for the manufacture of structural tubes of structural elements which are subjected to strong mechanical loads and stresses, particularly for door reinforcements in the manufacture of automobiles.

2. Description of the Related Art

In order to provide protection against side impacts during automobile accidents, the vehicle doors are frequently stiffened by means of reinforcing elements which partially absorb the kinetic energy of the impacting vehicle and convert the kinetic energy into plastic deformation. In order to be able to be used for this purpose, the steel tubes must meet relatively high requirements with respect to strength, ductility and working capacity. The same is true, for example, for structural tubes for manufacturing stabilizer or other structural components which are subjected to strong mechanical loads or stresses.

Structural tubes of this type are usually hot rolled, wherein the final rolling temperature is between 900° C. and 1080° C. The necessary strength properties can be adjusted in dependence on the used type of steel by water hardening. For example, a known steel which is manufactured in accordance with this method contains 0.18% C, 0.4% Si and 1.14% Mn, the remainder being iron and usual impurities. The significant disadvantage of this method is the fact that it requires additional heat treatment of the steel tube for adjusting the mechanical properties. On the one hand, an additional heat treatment makes the manufacture of such tubes more expensive. On the other hand, when hot forming operations are performed on the tube during the further processing thereof, for example, into door reinforcement tubes, the mechanical properties of the tube are changed in such a way that the strength properties may unintentionally be significantly lowered as compared to the initial condition of the tube. The same may occur in the heat influence zone of welding seams which may be necessary for assembly.

DE 37 28 476 C1 and DE 39 35 965 C1 disclose two other steel materials for reinforcement tubes which obtain their strength properties solely by an air cooling from the rolling heat as a result of their chemical compositions, so that no separate heat treatments are required. However, the use of these steels results in other significant disadvantages. Thus, both steels cannot be manufactured in a single-stage smelting process on a large scale by means of the LD method. This is because the high proportion of alloying elements makes it necessary to adjust the chemical composition in two partial stages which inevitably leads to increase in the expenses of producing the initial material. The two steels have the following chemical compositions in percent by weight:

| DE 37 28 476 C1 | DE 39 35 965 C1 |
|---|---|
| max. 0.35% C | 0.15–0.25% C |
| max. 0.50% Si | max. 0.60% Si |
| max. 1.80% Mn | 3.4–6.1% Mn |
| max. 0.030% P | max. 0.030% P |

-continued

| DE 37 28 476 C1 | DE 39 35 965 C1 |
|---|---|
| max. 0.030% S | max. 0.030% S |
| 0–1.5% N | 0–1.0% Ni |
| 1.8–2.2% Cr | 0–1.0% Cr |
| 0.4–0.7% Mo | 0–1.0% Mo |
| 0.025–0.050% Al | max. 0.005% Al |
| | 0–0.15% V |

the remainder being iron and usual impurities.

In order to adjust the required mechanical properties of the steel according to DE 37 28 476 C1, it is necessary to add large quantities of the elements Cr, Ni and Mo. However, an alloying concept on the basis of these elements is a relatively expensive solution mostly because of the costs of the alloying elements.

The steel described in DE 39 35 965 C1 has a high resistance to tempering which favorably influences the properties of the steel. These properties prevent a significant reduction of the strength properties during subsequent hot forming or during hot galvanizing. On the other hand, a disadvantage is the fact that the cold forming capability of this steel is extremely limited, as is the case in the steel of DE 37 28 476 C1. As a result, certain tube dimensions, as they can be manufactured directly by means of conventional hot forming, cannot be produced from this steel. DE 40 32 996 A1 discloses another steel for the manufacture of steel sections which are to be used as door reinforcements and have an outer corrosion protection by galvanizing. The steel has the following composition:

0.18–0.25% C
0.30–0.50% Si
1.30–2.00% Mn
0.1–0.5% Cr
0.1–0.3% Mo
0.02–0.07% Ti
0.002–0.007% B the remainder being iron and usual impurities.

Accordingly, this steel is a water hardening steel whose mechanical properties can only be adjusted after hot rolling by carrying out a special and separate heat treatment. Although the steel has the characteristics of a water hardening steel, steel tubes manufactured from this steel can be protected against corrosion by galvanizing them, without unduly reducing the adjusted strength properties by the resulting heating of the tubes.

SUMMARY OF THE INVENTION

Therefore, it is a primary object of the present invention to propose an air hardening steel to be used for the manufacture of structural tubes which can be subjected to high mechanical stress or load, particularly for the manufacture of automobiles, which can be produced by a single-stage melting process in LD converters and, because of its good strength properties, can be used already in the hot-rolled state; in other words, it is not necessary to subject the steel to a heat treatment prior to use in order to meet the mechanical minimum requirements of door reinforcement tubes with respect to tensile strength, yield strength and elongation after failure. Another object of the invention is to propose a steel of this type which additionally has substantially improved properties with respect to cold shaping.

In accordance with the present invention, an air hardening steel which is killed during casting is used as the material for the manufacture of structural tubes for structural elements which are subjected to high mechanical load or stress, particularly for door reinforcements in the manufacture of automobiles, wherein the steel has the following composition in percent by weight:

0. 15–0.30% C
0.50–0.80% Si
2.05–3.35% Mn
max. 0.03% P
max. 0.03% S
0.50–1.00% Cr
max. 0.60% Mo
max. 0.05% Al
0.01–0.05% Ti
0.0015–0.0035% B
0.002–0.015% N and wherein the sum of Mn, Cr, Mo and Si contents is at least 3.3% and the ratio of quantities Ti:N is adjusted to a value of at least 3.4.

Surprisingly, the object of the present invention could be met by simple measures. Compared to the steel known from DE 39 35 965 C1, the Mn content was significantly lowered and, on the other hand, minimum contents of Cr and Mo are required, so that the characteristics of an air hardening steel are maintained. Moreover, in order to ensure full quenching and tempering and to increase the strength, the present invention provides for the addition of B, wherein it is important to observe the upper limit of 0.0035% for maintaining the cold shaping capability of the structural tubes manufactured from this steel. The required Si content is also very important for achieving the high strength values. Finally, the adjustment of the minimum ratio Ti:N of 3.4 is to be pointed out, wherein the n content is to be limited to a value of between 0.002% and 0.015%.

The steel according to the present invention has all of the positive properties of the already known steels used for door reinforcement tubes as described above. Simultaneously, because of the particular chemical composition of the steel according to the present invention, the metallurgical process sequences during steel production have been simplified. Moreover, the steel makes it possible to cold shape the manufactured tubes, so that even precision steel tubes can be manufactured by means of cold drawing.

In summary, the steel has the following major properties:

single-stage steel production by means of the LD process;
inexpensive alloying elements;
air hardening capability;
high-resistance to tempering;
high strength properties; and
high energy absorption capacity.

In addition to door reinforcement tubes, the steel according to the present invention is also suitable for the manufacture, for example, of stabilizers which in the past were made of hardened and tempered precision steel tubes. The purpose of the stabilizers is to stiffen the axle bodies of motor vehicles when they are subjected to torsional load. For this purpose, the stabilizers must withstand in the torsion experiment with alternating load at a predetermined angle of rotation a number of load alternation switches as high as possible. The steel used in accordance with the present invention makes it possible to manufacture stabilizers which can be cold drawn after hot rolling.

Another advantageous use of the steel according to the present invention is for the manufacture of tubes for bicycle frames or, for example, for clothes stands which, for reasons of weight, must have walls which are as thin as possible.

DETAILED DESCRIPTION OF THE PREFERRED EMBODIMENTS

A steel having the following properties was produced in a single-stage melting process in a LD-converter and cast into a round casting:

0.25% C
0.74% Si
2.29% Mn
0.02% P
0.02% S
0.66% Cr
0.25% Mo
0.03% Al
0.046% Ti
0.0029% B
0.008% N remainder being iron and usual impurities.

The round casting sections were hot rolled into tubes having the dimension 25×5 mm and the tubes were cooled in air after the last shaping or forming step. Because of the specially adjusted alloy composition, the tubes had already in the hot-rolled state the properties required for the use as door reinforcement elements. For example, the following minimum values are required of ungalvanized tubes:

$R_m = 1400 N/mm^2$
$R_{p0.2} = 1000 N/mm^2$
$A_5 = 9\%$

In contrast, tubes manufactured with the steel according to the present invention had the following properties:

$R_m = 1610 N/mm^2$
$R_{p0.2} = 1040 N/mm^2$
$A_5 = 15\%$

The steel according to the present invention has the advantage that expensive elements, such as, nickel are completely avoided. Also, the elements chromium and molybdenum are present in only relatively small quantities. Since the steel has the characteristics of an air hardening steel, a separate heat treatment is unnecessary and, thus, the manufacturing costs are reduced.

The tubes can be subsequently subjected to a slight cold forming or shaping operation if the above-described requirements with respect to the mechanical properties of door reinforcement tubes are to be exceeded, i.e. if a special bending behavior is to be ensured in a specified quasi-static bending test. After this treatment has been carried out, the mechanical properties of the tubes, particularly the yield strength, are further improved because of the cold forming, so that even the highest requirements with respect to bending properties can be met. The tubes manufactured with the steel according to the present invention had the following mechanical properties after cold straightening:

$R_m = 1650 N/mm^2$
$R_{p0.2} = 1208 N/mm^2$
$A_5 = 11\%$

A similar effect can also be achieved by a tempering treatment. Because of the particular chemical composition and specifically selected mechanisms resulting from material properties, the yield strength of the steel increased as compared to the hot-rolled state after a tempering treatment at a temperature of about 350° C. The following mechanical properties were achieved.

$R_m = 1428$ N/mm²
$R_{p0.2} = 1236$ N/mm²
$A_5 = 15\%$

This process already shows the excellent tempering behavior of this steel which must also be emphasized. The mechanical characteristic values are even less reduced by a tempering treatment than is the case in the steel described, for example, in DE 40 32 996 Al. For this reason, the steel used in accordance with the present invention is particularly suitable for hot galvanizing for improving the corrosion protection. After hot galvanizing for 10 minutes in a zinc bath heated to 450° C., the tubes with the above-described composition had the following values:

$R_m = 1262$ N/mm²
$R_{p0.2} = 1128$ N/mm²
$A_5 = 15\%$

This means that the minimum values described in DE 40 32 996 Al for galvanized tubes were significantly exceeded:

$R_m = 1100$ N/mm²
$R_{p0.2} = 800$ N/mm²
$A_5 = 8\%$

There are a number of applications in which it is not possible to use a tube in the hot-rolled state, for example, because of the tube dimensions or the cross-sectional shape thereof. Examples of such applications are door reinforcement tubes having non-circular cross-sections or clothing stand tubes having dimensions which cannot be realized on hot rolling trains. For manufacturing these products, it is necessary that the steel used for the production can be further processed by means of a cold drawing process. The steel used in accordance with the present invention provides this possibility. A 30-minute annealing treatment at approximately 700° C. reduces the hardness of the steel to such an extent that cold drawing is possible without problems. In contrast, this is not possible in the steel according to DE 39 35 965 C1 even though this steel is soft annealed. The cold drawing of the steel results in significant strengthening of the steel, so that the mechanical property values which had been reduced by soft annealing are again raised, and the tubes are then available in the condition in which they can be used. In the case of tubes having the above-treatment mentioned chemical composition, which were cold drawn from the hot-rolled dimension 33.7 ×5 mm to the dimension 26×4 mm, the mechanical characteristic values were as follows:

$R_m = 1049$ N/mm²
$R_{p0.2} = 982$ N/mm²
$A_5 = 13\%$

If required, the values can again be reduced to the initial level for hot-rolled tubes by another heat treatment.

The invention is not limited by the embodiments described above which are presented as examples only but can be modified in various ways within the scope of protection defined by the appended patent claims.

We claim:

1. A hot rolled and air hardened steel comprising, in per by weight:

0.15–0.30% C
0.50–0.80% Si
2.05–3.35% Mn
max. 0.03% P
max. 0.03% S
0.50–1.00% Cr
max. 0.60% Mo
max. 0.05% Al
0.01–0.05% Ti
0.0015–0.0035% B
0.002–0.015% N remainder iron and impurities, wherein:

Ti(%):N(%)≧3.4%

Mn(%)+Cr(%)+Mo(%)+Si(%)≧3.3%, and wherein said steel exhibits, after hot rolling and air hardening at least the following minimum values:

$R_m = 1400$ N/mm²
$R_{p0.2} = 1000$ N/mm²
$A_5 = 9\%$.

2. A method of manufacturing structural elements which are subjected to high mechanical loads, the method comprising casting an air hardening steel into castings, hot rolling the castings into structural elements and air cooling said castings, the steel comprising in per cent of weight:

0.15–0.30% C
0.50–0.80% Si
2.05–3.35% Mn
max. 0.03% P
max. 0.03% S
0.50–1.00% Cr
max. 0.60% Mo
max. 0.05Al
0.01–0.05% Ti
0.0015–0.0035% B
0.002–0.015% N remainder iron and impurities, wherein:

Ti(%):N(%)≧3.4%

Mn(%)+Cr(%)+Mo(%)+Si(%)≧3.3%, said steel exhibiting, after said hot rolling and air cooling, at least the following minimum values:

$R_m = 1400$ N/mm²
$R_{p.02} = 1000$ mm²
$A_5 = 9\%$

3. The method according to claim 2, wherein the steel is killed.

4. A door reinforcement tube for reinforcing a door of a motor vehicle, the door reinforcement tube having been formed by hot rolling and air cooling an air hardening steel comprising in percent by weight:

0.15–0.30% C
0.50–0.80% Si
2.05–3.35% Mn
max. 0.03% P
max. 0.03% S
0.50–1.00% Cr
max. 0.60% Mo
max. 0.05% Al
0.01–0.05% Ti
0.0015–0.0035% B
0.002–0.015% N remainder iron and impurities, wherein:

Ti(%):N(%)≧3.4%

Mn(%)+Cr(%)+Mo(%)+Si(%)≧3.33%, and wherein said door reinforcement tube exhibits, after said hot rolling and air cooling, at least the following minimum values:

$R_m = 1400$ N/mm²
$R_{p0.2} = 1000$ N/mm²
$A_5 = 9\%$.

* * * * *